US005335732A

United States Patent [19]

McIntyre

[11] Patent Number: 5,335,732

[45] Date of Patent: Aug. 9, 1994

[54] OIL RECOVERY COMBINED WITH INJECTION OF PRODUCED WATER

[76] Inventor: Jack W. McIntyre, 107 N. Overland, Fort Stockton, Tex. 79735

[21] Appl. No.: 998,018

[22] Filed: Dec. 29, 1992

[51] Int. Cl.[5] ..... E21B 33/124; E21B 43/14

[52] U.S. Cl. ..... 166/313; 166/52; 166/369; 166/387

[58] Field of Search ..... 166/265, 313, 369, 52, 166/306, 387

[56] References Cited

U.S. PATENT DOCUMENTS

| | | | |
|---|---|---|---|
| 2,855,047 | 10/1958 | Widmyer | 166/313 X |
| 3,167,125 | 1/1965 | Bryan | 166/306 |
| 3,825,070 | 7/1974 | Hoyt | 166/306 |
| 4,766,957 | 8/1988 | McIntyre | 166/265 |
| 4,770,243 | 9/1988 | Fouillout et al. | 166/53 |
| 4,805,697 | 2/1989 | Fouillout et al. | 166/265 |
| 4,901,798 | 2/1990 | Amani | 166/311 |

*Primary Examiner*—William P. Neuder

*Attorney, Agent, or Firm*—Pravel, Hewitt, Kimball & Krieger

[57] ABSTRACT

Method and apparatus for simultaneously producing hydrocarbon and water from the same stratum through spaced apart sets of perforations. The water is monitored for hydrocarbon content and injected into a disposal zone. The hydrocarbon content of the water and the water content of produced hydrocarbon are used to control the pumping rate of the water stream.

8 Claims, 1 Drawing Sheet

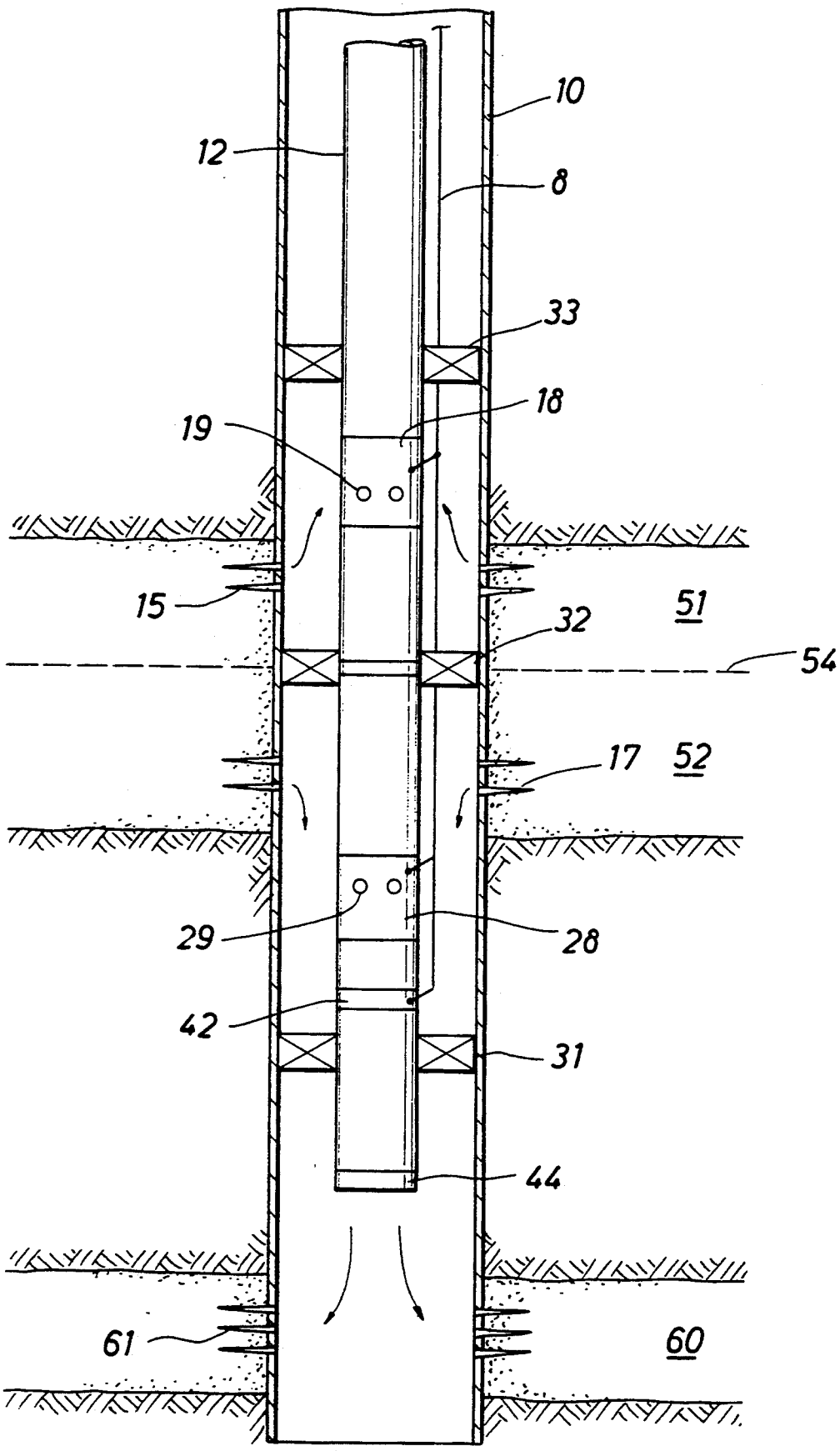
10
12
8
33
18
19
15
51
32
54
17
52
29
28
42
31
44
61
60

OIL RECOVERY COMBINED WITH INJECTION OF PRODUCED WATER

BACKGROUND OF THE INVENTION

1. Field of the Invention

This invention relates to methods of producing hydrocarbons from a well drilled through a subterranean formation. More particularly, a method for production of hydrocarbon and water through separate sets of perforations and injecting water into a disposal zone without producing the water to surface is provided.

2. Description of Related Art

Hydrocarbons, both liquid and gaseous, exist in the earth in many different types of rock strata. Some strata containing hydrocarbons are of very limited vertical extent and are bounded by impermeable layers. Production of the hydrocarbons from these thin strata often allows water (brine) to encroach naturally on the production wells, and when water production begins at a well the rate of water production increases rapidly and the wells are soon abandoned. In other thin strata, encroachment of water does not occur naturally and water is injected through selected wells into the strata to "flood" the hydrocarbons from the strata. Again, when water encroaches on a well, the well is usually abandoned soon thereafter. In these thin hydrocarbon reservoirs, there is little effect of gravity in separating the hydrocarbons and water in the reservoir, and the contact between hydrocarbon and water is at a substantial angle with respect to horizontal.

When a reservoir containing hydrocarbons is sufficiently thick, or production rate is sufficiently low, or permeability to flow in the rock is sufficiently high, or a combination of these conditions exists, the difference in density between hydrocarbons and water will cause a segregation of the fluids in the reservoir rock, with water being concentrated in the lower part of the reservoir. The oil-water contact zone will be approximately horizontal. If the dip angle of the reservoir is low, the oil-water interface will normally move up very slowly as hydrocarbons are produced from the reservoir and the contact zone between hydrocarbons and water may extend over the entire reservoir.

The zone between hydrocarbon and water is commonly referred to as the "oil-water contact" in a reservoir. The oil-water contact actually extends over a vertical distance in a reservoir, sometimes called a "transition zone," the distance of which is determined by fluid densities and capillary pressures in the rock. In a highly permeable rock, the transition zone is short, as little as a few inches, because capillary pressures are low. In extremely low permeability rock, the transition zone may extend over many feet. In the transition zone, the saturation of the pore spaces of the rock changes from predominantly water to predominantly hydrocarbon. At the highest saturations of hydrocarbons, water will not flow through the rock, being trapped in the rock by the hydrocarbons, and the permeability to flow of hydrocarbons is at its maximum value.

Although idealized sketches are prepared of fluid saturations in reservoirs and flow patterns in reservoirs, it is known in the art that properties of reservoir rocks vary widely within a hydrocarbon reservoir. Permeability and capillary pressures, in particular, vary from point-to-point, both in a vertical and a horizontal direction, but particularly in a vertical direction, as the strata often consist of beds having different properties that were formed under differing geologic conditions. These variations are difficult to impossible to predict with accuracy, and can only be measured by expensive techniques, such as analysis of cores cut from the rock around an individual well. Therefore, the saturation of hydrocarbons and water in the pore spaces of a reservoir is expected to vary in a somewhat unpredictable manner. Also, the relative amount of water produced with hydrocarbons into a well cannot be forecast with accuracy because of rock property variations when the well is producing from near the hydrocarbon-water interface in a stratum.

The location of the hydrocarbon-water contact near a production well may be affected by production from the well, because of the phenomenon of fluid "coning." Production above the oil-water contact may cause water to be drawn upward to the perforations and may lead to excessive water production from the well. Similarly, production of water below the oil-water contact tends to cause the contact to be pulled downward to the perforations.

When water and oil are produced through perforations in casing and up tubing in a wellbore, either by natural pressure or artificial lift methods, water often becomes emulsified in the oil. It is believed that a significant part of this emulsification occurs during simultaneous flow of the fluids through perforations. Therefore, minimizing mixing of water and oil in perforations will decrease the emulsification of fluids during production.

When water is produced from the earth along with hydrocarbons, it is normally pumped to the surface and disposed of by injection into another well. A disposal strata for the water must not contain water that is valuable, such as fresh water, and the disposal wells must not pose any threat to contamination of valuable water. The pumping of brine to the surface along with hydrocarbons and subsequent disposal through another well creates a risk of environmental pollution from such incidents as broken lines, spills, overflow of tanks and other occurrences. It would obviously be environmentally safer to dispose of the brine in the subsurface without producing it to the surface of the earth.

U.S. Pat. No. 4,766,957 discloses a method and apparatus for production of hydrocarbons with disposal of water produced along with hydrocarbons by producing the water and hydrocarbon from the same set of perforations in casing, separating water and hydrocarbon by gravity in or near the wellbore, and pumping the water to a lower water disposal zone as hydrocarbon flows to the surface.

U.S. Pat. No. 4,805,697 discloses a method and apparatus for production of hydrocarbons along with water from the same set of perforations by separating the water and hydrocarbon in the wellbore using a mechanical device and pumping the water to a disposal zone at a rate controlled by the content of oil in the separated water. U.S. Pat. No. 4,770,243 discloses specific apparatus for monitoring the content of oil in the separated water and controlling the rate of pumping of water into the disposal strata.

There is a long felt need for a method and apparatus for producing hydrocarbons from strata having a hydrocarbon-water interface lying substantially in a horizontal direction with a limited extent of transition zone by which the production of water and hydrocarbon can be controlled to minimize emulsification, while minimizing the effects of coning, and for disposing of the produced water in an environmentally safe manner.

SUMMARY OF THE INVENTION

A method is provided for producing hydrocarbons selectively through one set of perforations and water selectively through another set of perforations and disposing of the water subsurface. A plugged packer on tubing is placed between the hydrocarbon and water zone to allow separation of production from the different zones. A second packer and a subsurface pump are placed between the water zone and a separate disposal stratum to allow disposal of the water without pumping it to the surface of the earth. In another embodiment, the amount of hydrocarbon in the water stream being disposed of is monitored. In another embodiment, the rate of pumping of at least one stream is varied in response to the amount of hydrocarbon in the water stream injected. In yet another embodiment, apparatus comprising tubing, packers, a subsurface pumping unit and a sensor in the water stream are provided.

BRIEF DESCRIPTION OF THE DRAWINGS

FIG. 1 is a drawing of a well equipped for practicing this invention, showing hydrocarbon and water production through separate sets of perforations, production of hydrocarbon to the surface and downhole injection of produced water in the same well.

DESCRIPTION OF PREFERRED EMBODIMENTS

Referring now to FIG. 1, casing 10 extends through two strata in the earth—strata 50, containing a hydrocarbon zone 51 overlying a water zone 52, and strata 60, a strata suitable for disposal of the aqueous phase (water or brine) produced from strata 50. In strata 50 there exists hydrocarbon-water contact 54, which has a transition zone of vertical extent substantially less than the vertical extent of strata 50.

Tubing 12 has been placed in the well, suitably sized to allow production and injection at rates of flow expected in the well. Flow into the casing occurs through set of perforations 15 in the hydrocarbon zone and set of perforations 17 in the water zone of strata 50. As indicated by arrows, flow of hydrocarbon upward into inlet ports 19 of pump unit 18. Pump unit 18 is depicted in FIG. 1 as an electrically powered pump for liquids, such as a centrifugal pump, which is well-known in the art. Pump unit 18 is powered by electrical power from the surface brought to the motor in wire conduit 8. Any other suitable pump may be used, such as a rod pump or hydraulic pump. If gaseous hydrocarbon is produced instead of liquid, pump unit 18 will not be used, or if the hydrocarbon is liquid but the pressure in strata 50 is sufficiently high, liquid hydrocarbon will be driven to the surface by natural pressure in the strata and pump unit 18 will not be necessary.

Water enters the wellbore through set of perforations 17 and flows downward, separated from the hydrocarbon stream in the wellbore by tubing packer and plug 32. The packer prevents mixing of the hydrocarbon and water outside the tubing and the plug isolates the two streams inside the tubing. The water stream flows downward from perforations 17 and enters inlet ports 29 of pump unit 28. Pump unit 28 is also depicted as an electrically driven pump, powered through electrical conduit 8 from the surface. (Although conduit 8 is depicted as a single line, it may contain a number of conductors, both for conveying electrical power and transmitting signals to and from downhole. Such flexible conduits and equipment for installation are well-known in the industry.) The motor driving pump unit 18 is variable speed, the speed being determined by a controller which may be at the surface or downhole. Flow outside the tubing between disposal stratum 60 and zone of water production 52 is prevented by tubing packer 31.

The water stream flows through tubing 12 to a hydrocarbon-in-water sensor 42. The sensor may be of a variety of types. One type is a fluorescence analyzer, such as that disclosed in U.S. Pat. No. 4,770,243, referred to above, if the hydrocarbon is a fluorescent liquid. Another type sensor would measure turbidity of the water stream. Another would measure the gas content by sonic means. Many such sensors are generally known in the art, and are routinely used to monitor hydrocarbon content of water streams in plants and streams discharging into the environment. The signal from sensor 42 may be conveyed to the surface through conduit 8 or may be conveyed to a controller included in pump unit 28, the controller being used to vary the rate of pumping of the unit. In either case, sensor 42 is used to control the rate of pumping of water through flow check valve 44 and into set of perforations 61. The function of valve 44 is to prevent backflow when injection is stopped. The water stream is then disposed of in strata 60. Strata 60 preferably has high permeability to flow such that injection pressure will be below fracturing pressures, but, if necessary, flowing pressures at perforations 61 may be high enough to hydraulically fracture strata 60. Strata 60 is selected for suitability as an injection zone using criteria well known in industry. Although strata 60 is depicted as below strata 50, strata 60 may be located above strata 50, in which case tubing 12 would be provided with a U-shape section downstream from pumping unit 28 to direct flow upward through tubing, sensor 42 and flow check valve 44 into a disposal strata above strata 50. Tubing packer 32 and, if necessary, tubing packer 33 would then be dual packers. Such an arrangement is unlikely to be necessary, as a disposal strata below a production zone can normally be used.

Sets of perforations 15 and 17 are preferably located at a distance removed from hydrocarbon-water contact 54 and the transition zone associated with the contact. If perforations are near such contact 54, the method of this invention may still be useful.

Preferably, the rate of pump unit 28 and pump unit 18 are controlled such that coning in strata 50 is minimized, i.e., the oil-water contact is not pulled substantially to either of the two sets of perforations, 15 and 17. Since there is no method available for measuring the position of this contact when hydrocarbon and water are being produced, control of pumping rate at the two pumps is used to indicate if a cone has formed in the reservoir of strata 50. A water cone would be indicated by excessive rate of water production and a hydrocarbon cone by excessive amount of hydrocarbon indicated in the water injection stream, as indicated by sensor 42. Excessive rates of water production in the oil stream, as measured at the surface, are treated either by increasing the rate of pump unit 28 or by decreasing the rate of pump unit 18. Excessive rates of hydrocarbon in the water stream, as determined by sensor 42, are treated by decreasing the rate of pump unit 28.

Usually in the depletion of a hydrocarbon reservoir the zone 51 will become smaller and the hydrocarbon-water interface will move upward. This may be partially compensated by increasing the rate of pump unit 28, to increase rate of water production and injection, but such rate increase cannot be so great as to cone hydrocarbon down into the set of perforations 17.

Production of most of the hydrocarbon through perforations 15 and most of the water through perforations 17 will minimize the formation of emulsions as the fluids are produced.

If desired to increase the efficiency of the separation of hydrocarbon and water in the reservoir of strata 50, the locations of perforations 15 and 17 and the setting depth of the pumping units 18 and 28 can be changed, using routine techniques known in industry. Such changes will be made in response to the amounts of hydrocarbon and water being produced in each of the streams.

It will be appreciated that while the present invention has been primarily described with regard to the foregoing embodiments, it should be understood that variations and modifications may be made in the embodiments described herein without departing from the broad inventive concept disclosed above or claimed hereafter.

What is claimed is:

1. A method for producing hydrocarbons from a stratum in which a hydrocarbon zone overlies and is in pressure communication with an underlying water zone comprising:

drilling and placing casing in a well, the casing extending through the stratum having the hydrocarbon zone and the underlying water zone and through at least a portion of a separate water disposal stratum;

perforating the casing in the hydrocarbon zone, the water zone and the water disposal stratum;

placing tubing in the well, the tubing having packers disposed at selected locations thereon;

setting a packer in the casing between the perforations in the hydrocarbon zone and the perforations in the underlying water zone, the packer having a plug therein;

setting a packer in the casing between the perforations in the water zone and perforations in the water disposal stratum; and producing two streams, one stream of hydrocarbons from the hydrocarbon zone and a second stream from the underlying water zone, and simultaneously pumping water from the water zone to the water disposal stratum.

2. The method of claim 1 additionally comprising measuring the content of hydrocarbon in the water stream injected into the water disposal stratum.

3. The method of claim 1 additionally comprising measuring the content of hydrocarbon in the water stream injected into the water disposal stratum and adjusting the rate of production of at least one of the two streams in response thereto.

4. Apparatus for simultaneously producing hydrocarbons and water from a cased well drilled into subterranean strata, the casing being perforated by two spaced apart sets of perforations, the first set being in a hydrocarbon zone and the second set being in an underlying water zone which is in pressure communication with the hydrocarbon zone, comprising:

a string of tubing;

a first tubing packer, the packer being set at a depth in proximity to the depth of the hydrocarbon-water contact at the well, the packer being plugged to prevent flow through the tubing connected to the packer;

a second tubing packer, the packer being set between the perforations in the water zone and perforations in a water disposal stratum;

a subsurface pumping unit to inject water from the water zone into a disposal zone; and a sensor in the water stream injected to detect the amount of hydrocarbons in the stream.

5. The apparatus of claim 4 additionally comprising a check valve in the tubing conveying the water stream to be injected to prevent backflow of water when injection is stopped.

6. The apparatus of claim 4 additionally comprising a third tubing packer set in the casing between the set of perforations in the hydrocarbon zone and the surface.

7. The apparatus of claim 4 wherein the pumping unit is powered by electrical power from the surface.

8. The apparatus of claim 4 wherein the sensor is responsive to fluorescent hydrocarbons.

* * * * *